US008152121B2

(12) United States Patent
Thomas et al.

(10) Patent No.: US 8,152,121 B2
(45) Date of Patent: Apr. 10, 2012

(54) BRACKET FOR THERMAL EXPANSION VALVE BULB

(75) Inventors: Jason Michael Thomas, Morgantown, IN (US); Floyd J. Frenia, Brownsburg, IN (US); Thomas K. Rembold, Danville, IN (US); Arturo Rios, Avon, IN (US); Michael V. Hubbard, Pittsboro, IN (US)

(73) Assignee: Carrier Corporation, Farmington, CT (US)

( * ) Notice: Subject to any disclaimer, the term of this patent is extended or adjusted under 35 U.S.C. 154(b) by 236 days.

(21) Appl. No.: 12/521,075

(22) PCT Filed: Dec. 28, 2006

(86) PCT No.: PCT/US2006/049554

§ 371 (c)(1),
(2), (4) Date: Jun. 24, 2009

(87) PCT Pub. No.: WO2008/091243

PCT Pub. Date: Jul. 31, 2008

(65) Prior Publication Data

US 2010/0064713 A1 Mar. 18, 2010

(51) Int. Cl.

| | |
|---|---|
| ***A47B 96/06*** | (2006.01) |
| ***E04G 5/06*** | (2006.01) |
| ***F16L 3/08*** | (2006.01) |
| ***F21V 21/00*** | (2006.01) |

(52) U.S. Cl. ..... 248/229.1; 248/229.14; 248/68.1

(58) Field of Classification Search ..... 248/229.14, 248/68.1; 24/16 PB

See application file for complete search history.

(56) References Cited

U.S. PATENT DOCUMENTS

| | | | | |
|---|---|---|---|---|
| 5,035,383 | A * | 7/1991 | Rainville | 248/68.1 |
| 5,653,411 | A | 8/1997 | Picco et al. | |
| 5,785,285 | A | 7/1998 | Gordon | |
| 5,908,181 | A * | 6/1999 | Valles-Navarro | 248/177.1 |
| D415,017 | S * | 10/1999 | Lo | D8/396 |
| 6,431,502 | B1 * | 8/2002 | Goodman | 248/74.1 |
| 6,702,814 | B2 * | 3/2004 | Walulik et al. | 606/57 |
| 6,860,165 | B2 * | 3/2005 | Das et al. | 73/866.5 |
| 7,055,784 | B2 * | 6/2006 | Stigler | 248/74.1 |
| 7,472,870 | B2 * | 1/2009 | Zagorski et al. | 248/65 |

OTHER PUBLICATIONS

International Search Report and Written Opinion mailed Nov. 23, 2007 (7 pgs.).

* cited by examiner

*Primary Examiner* — Amy J Sterling
(74) *Attorney, Agent, or Firm* — Cantor Colburn LLP

(57) ABSTRACT

A single bracket serves to both attach a TXV bulb to an outer surface of an outlet header and to place a securely hold the distribution assembly in a fixed position with respect to the TXV bulb. A pair of clam shell clamping members on opposite ends of a central member are put in position and clamped to hold the TXV bulb tightly in place against the outlet header and to clamp around the equalizer of the distributor assembly, thereby resulting in a rigid interconnection which maintains the desired positions for each of the components.

14 Claims, 2 Drawing Sheets

BRACKET FOR THERMAL EXPANSION VALVE BULB

BACKGROUND OF THE INVENTION

This invention relates generally to refrigeration systems and, more particularly, to a method and apparatus for mounting a distributor and thermal expansion valve assembly in a refrigeration system.

In air conditioning and refrigeration systems it is common to maintain a certain degree of superheat in the refrigerant passing from the evaporator to the compressor in order to protect the compressor from damage that can occur by liquid refrigerant passing therethrough. This is accomplished by using a thermal expansion valve (TXV) upstream of the evaporator coil, with an associated temperature sensor or bulb for sensing the temperature of the refrigerant passing from the evaporator coil.

In one type of air conditioner that is used in combination with a furnace, an A-coil is provided with a piping assembly which includes the thermal expansion valve being attached to the liquid line and, in close proximity, the sensor bulb being attached to the outlet header.

In order for the bulb to provide accurate temperature readings, it is necessary to mount the bulb in such a way as to ensure a fixed and firm engagement with the header and to isolate the bulb from the surroundings. The first function had generally been served by one or more clamps and the second function has generally been accomplished by providing some kind of protective cover over the area in which the bulb is secured to the outlet line. The most common type of insulation that is provided around the bulb of an A-coil is a foam tape that is wrapped around the clamp. The problems with this approach are twofold. First, it is difficult to access that portion of the piping assembly and to obtain a firm and proper securing of the clamp and bulb to the outlet header. Secondly, the wrapping of the insulation tape will vary greatly with the serviceman applying it and may well not be sufficient to ensure good isolation of the bulb that would result in accurate readings.

Other types of temperature sensors are also used to sense refrigerant temperatures in various lines of a refrigeration system for purposes of control and/or protection of the system. These sensors are subject to the same problems as discussed hereinabove.

Another problem that occurs with A-coil piping assemblies is that of the distributor assembly, which includes both the TXV and the liquid line leading to it, vibrating in shipping or operational use and eventually causing failure of the liquid line. This problem is presently addressed by a separate clamp that rigidly interconnects the liquid line to the outlet header.

SUMMARY OF THE INVENTION

Briefly, in accordance with one aspect of the invention, a pre-formed and insulated bracket is wrapped around the bulb so as to securely attach it to the outlet line and provide an insulating cover thereover.

By another aspect of the invention, the bracket also extends around the liquid line to secure the distributor assembly in its correct relationship to the outlet header.

In the drawings as hereinafter described, a preferred embodiment is depicted; however, various other modifications and alternate constructions can be made thereto without departing from the spirit and scope of the invention.

DESCRIPTION OF THE PREFERRED EMBODIMENT

Figure 1:
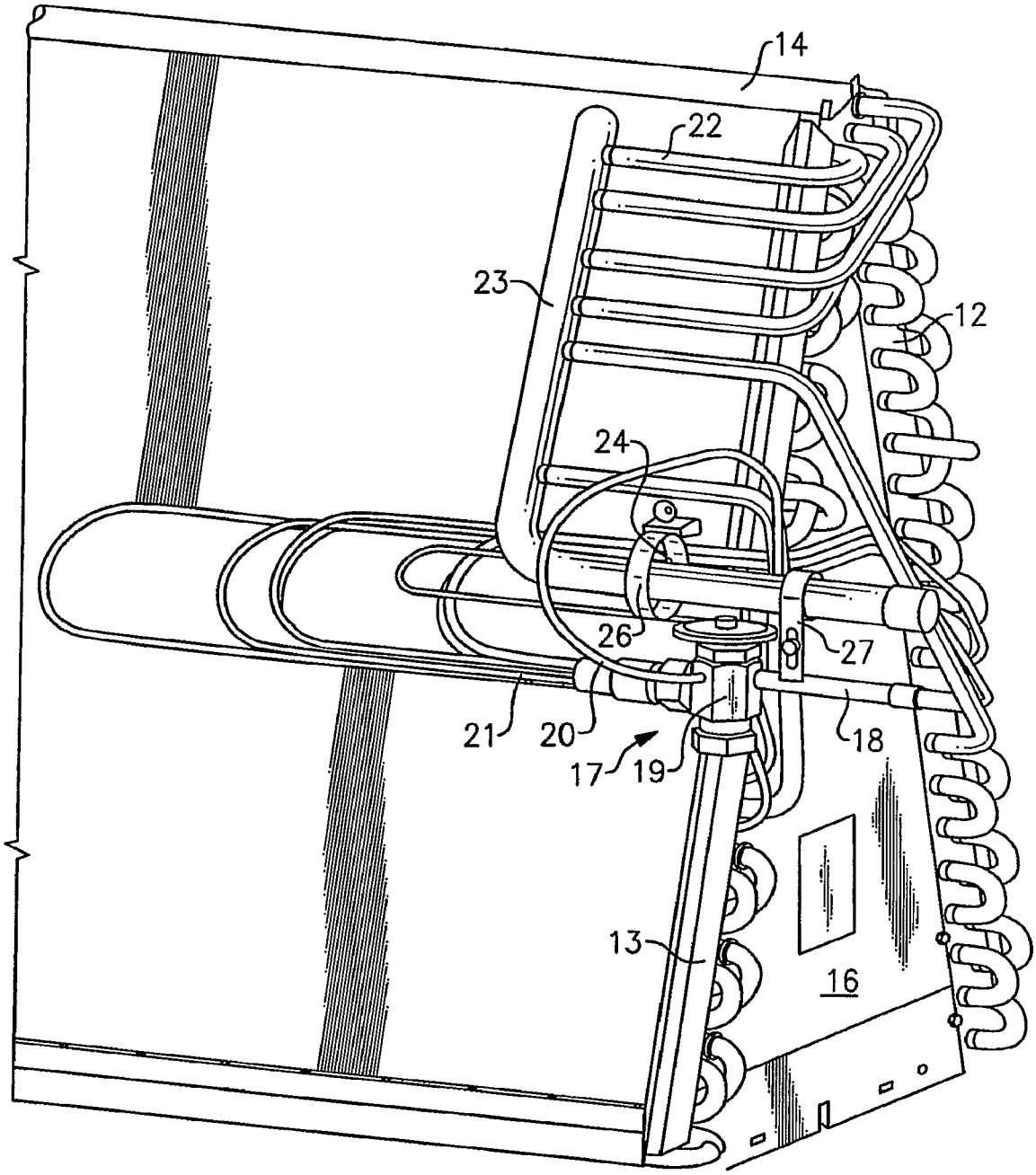
FIG. 1 is a perspective view of a piping assembly for an A-coil in accordance with the prior art.

Referring to FIG. 1, there is shown an A-coil assembly comprising a pair of evaporator coils 12 and 13 attached at their upper ends 14 to form an A-shape in a well known manner. An end plate 16 is installed in each end of the A-coil.

An A-coil assembly is commonly used in a furnace to provide an air conditioning mode of operation, with the furnace blower acting to receive return air from a building and pass it through the A-coil to be cooled prior to flowing out of the duct to cool the building. The present invention is related to the refrigeration circuit that is associated with the A-coil assembly 11.

In a line coming from the condenser, which is located in the outdoor coil, the refrigerant flows to the distributor assembly 17. The distributor assembly includes a liquid line 18, a thermal expansion valve (TXV) 19 with an equalizer line 20 and a plurality of capillary tubes 21 which carry the distributed refrigerant vapor to the various circuits in the coils 12 and 13. The TXV operates to selectively control the degree of expansion of the refrigerant into the capillary tubes 21.

On the downstream side of the unit, the refrigerant vapor, after having been heated by heat exchange relationship with air passing through the coils 12 and 13, passes through the plurality of tubes 22 to an outlet header 23, from where it then flows to the compressor, after which the compressed vapor then passes to the condenser to complete the refrigerant cycle.

In order to ensure that all of the refrigerant passing to the compressor is in the vapor form (i.e. to prevent liquid refrigerant from passing to the compressor and causing damage), it is desirable to maintain the refrigerant passing from the header 23 in a superheated condition. This is accomplished by controlling the TXV in order to maintain a constant superheat at the coil outlet regardless of load conditions. That is, the size oldie variable orifice in the TXV 19 is determined by a temperature sensor or a TXV bulb 24 which is attached to the outlet header 23 in such a way as to sense the temperature of the refrigerant passing through the header 23 and to activate the TXV in response thereto.

In order to ensure that the TXV bulb is held tightly and consistently against the wall of the outlet header 23, so as to provide an accurate sensing of the refrigerant temperature, a hose clamp 26 has generally been used as shown.

In addition to the hose clamp 26, it has been found necessary to insulate the TXV bulb by isolating it from the surrounding area. This has generally been done by wrapping foam tape around the hose clamp 26.

The applicants, have recognized that both the installation, of the hose clamp 26 and the insulated tape can vary substantially between one assembly person and another, and may well result in an improper installation, which will cause improper readings of the TXV bulb and improper operation of the TXV.

It is desirable to place the distributor assembly 17 near that portion of the outlet header 23 or which the TXV bulb is attached. Further, it is desirable to provide structural support for the distributor assembly since shipping and. Or operational vibrations are likely to cause a failure in unsupported portions thereof such as at the equalizer line 20. These functions have been accomplished in the past by a separate bracket 27 that wraps around both the outlet header 23 and the liquid line 18 to both position the distributor assembly 17 and prevent the vibrations that would otherwise occur.

The present invention is intended to serve the purposes of the hose clamp 26, the insulation wrap, and the bracket 27.

Referring now to FIGS. 2-6, the bracket of the present invention is shown at 28 with a primary or first clamp member attached to its one end and a secondary or second clamp member 32 attached at its other end thereof.

Figure 5:
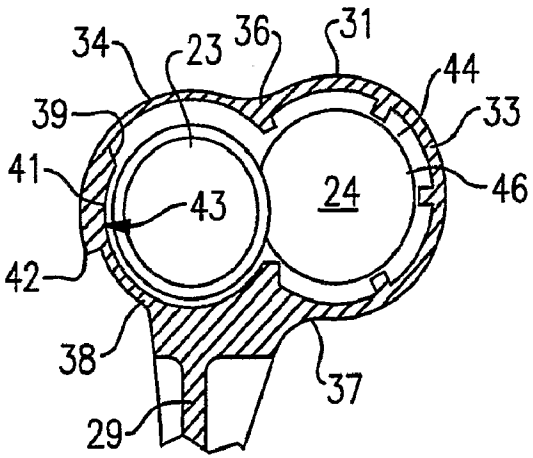
FIG. 5 is a sectional view thereof as seen along lines 5-5 of FIG. 3.
Figure 4:
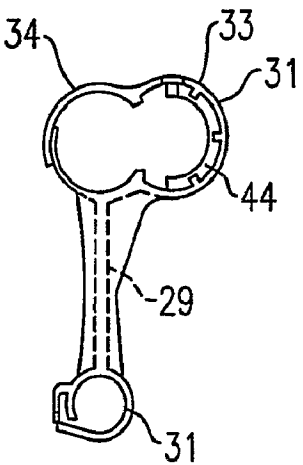
FIG. 4 is an end view thereof.
Figure 2:
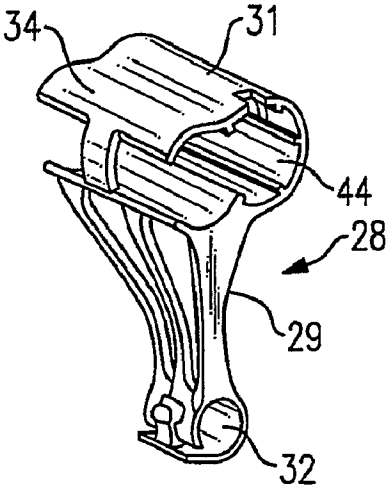
FIG. 2 is a perspective view of the bracket in accordance with the present invention.
Figure 3:
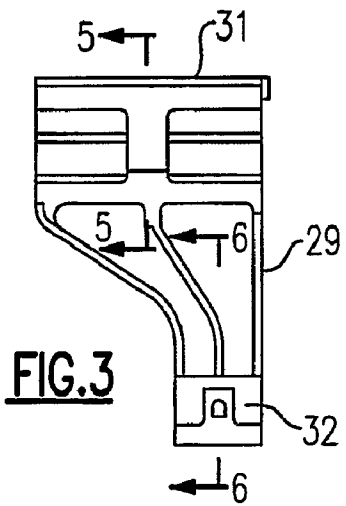
FIG. 3 is a front side view thereof.

As will be best seen in FIG. 5, the first clamp member 31 has a base arcuate member 33 and a distal arcuate member 34 interconnected in an integral manner at an intermediate point 36. The base arcuate member 33 is integrally connected to the elongate central member 29 at connection point 37. It should be understood, however, that the base arcuate member 33 may be a separate unit rather than integral with the central member 29 as shown and may be connected by other means such as by a fastener or the like. In this regard, it is necessary that the first clamp member 31 be hinged or flexible to the degree which would allow it to be opened from its relationship with the central member 29 to allow it to be installed in a manner to be described hereinafter.

At the one end of the central member 29 there is an integrally connected cradle portion 38 which is arcuate in form with a leg extending upwardly to a point 39. On an outer side of the cradle member 38, near the end 39, are a plurality of generally downwardly extending teeth 41. In a related manner, the distal arcuate member 34 extends downwardly to an end 42 and has generally upwardly extending teeth 43 that are adapted to engage the teeth 41 when the first clamp member 31 is in a closed position.

Disposed within the base arcuate member 33 is a liner 44 which is generally coaxial with the base arcuate member 33 and serves to hold the bulb in place (i.e. to prevent it from coming out of the front or back of the charge). Located on the inner diameter of the liner 44 is a sheet of insulation 46 that closely adheres to the inner diameter of the liner 44 and acts to insulate the TXV bulb from outside temperatures in a manner to be described hereinafter.

The insulation 46 may be a separate element as shown that is either attached to the liner 44 or as a separate piece that is set in to the position against the inner diameter of the liner 44. Alternatively, the insulation may be integrated into the base arcuate member 33 as, for example, by being integrated into the material of the liner 33. A typical material that would be used in the embodiment as shown for the insulation 46 is a closed cell foam or any suitable insulating material.

Referring, now to the second clamp member 32 at the other end of the central member 29, the clamp member 32 is arcuate in form, extending downwardly and around a bottom portion of a cavity 47 and then upwardly on the other side to a termination point 48. On the other side is a downwardly extending U-shaped portion 49 into which the termination point 48 extends. Again, the second clamp member 32 is composed of a material which is flexible to allow the clamp to be opened by withdrawing the termination point 48 downwardly to the extent that the equalizer line 18 can be inserted into the cavity 47, after which, the termination point is inserted back into the U-shaped portion 49 and locked in place. This can be accomplished by engaging a hook on the outer portion of the U-shaped member 49 until, it engages an edge of the outer side of the termination point 48 as shown in FIG. 6.

Considering now the manner in which the bracket 28 is installed in an A-coil assembly, and the outlet header 23 and the liquid line 18, in particular, the respective teeth 41 and 43 are disengaged and the first clamp member is opened to the degree which will allow the base arcuate member 33 to be placed over the TXV bulb 24 as shown in FIG. 5. The cradle member 38 is then brought up under the outlet header 23 such that the surface of the TXV bulb 24 engages the outer surface of the outlet header 23 as shown. The first clamp member 31 is then brought to the closed position such that the base arcuate member 33 is tightly held against the outer surface of the TXV bulb 24 and the bulb closely engages the outer surface of the outlet header 23. In turn, the distal arcuate member 34 wraps around the outer surface of the outlet header 23 and the respective teeth 41 and 43 are engaged to hold the first clamp member 31 in a closed position.

Figure 6:
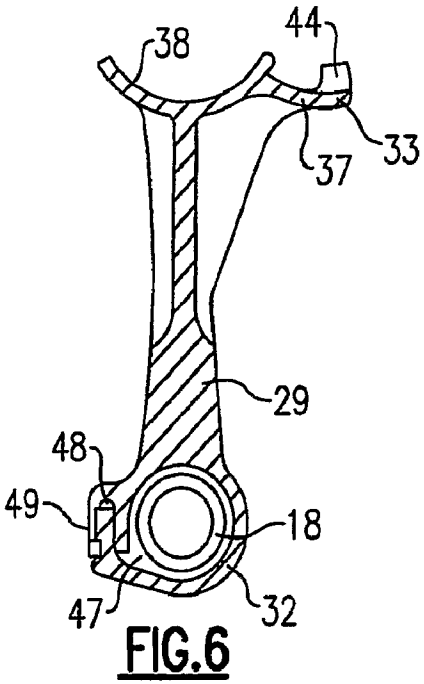
FIG. 6 is a sectional view thereof as seen along lines 6-6 of FIG. 3.

In a subsequent, step or in an initial step of one prefers, the second clamp member 32 is moved to the open position, and placed over the liquid line 18 as shown in FIG. 6 and then moved to the closed position. The result is a rigid attachment between the outlet header 23 and the liquid line 18 such that the distributor assembly 17 is held in its place with respect to the TXV bulb and prevented from vibrating during shipping or when the system is operating. At the same time, the TXV bulb is securely held in place and in a precise and consistent manner so as to provide accurate readings for control of the TXV.

The bracket 28 is preferably a unitary member as shown but may well be of multiple interconnected members. The material with which it is made is preferably a flexible plastic material such as nylon. However, it is understood that various other materials can as well be used in accordance with the present invention.

We claim:

1. In an air conditioning A-coil having an outlet header, a bracket for securing both a thermal expansion valve bulb and a distributor assembly to the outlet header of the air conditioning A-coil, the bracket comprising:

an elongate member having a first clamp member attached to one end and a second clamp member attached to its other end;

said first clamp member comprising a base arcuate member and a distal arcuate member, said base arcuate member being attached at its one end to said elongate member and wrapping around the thermal expansion valve bulb, and said distal arcuate member being attached to said base arcuate member other end and wrapping around a portion of said outlet header;

fastening means to secure said first clamp member distal arcuate member to said outlet header;

said second clamp member comprising an arcuate member wrapping around a portion of the distribution assembly; and fastening means for fastening said second clamp member to said distribution assembly.

2. The bracket as set forth in claim 1 wherein said bracket is a unitary member.

3. The bracket as set forth in claim 1 wherein said bracket is comprised of a plastic material.

4. The bracket as set forth in claim 1 and including an insulating member disposed between said thermal expansion valve bulb and said base arcuate member.

5. The bracket as set forth in claim 1 wherein said elongate member includes a cradle member at its one end, said cradle member being arcuate in form and engagingly receiving said outlet header therein; and said first clamp member distal arcuate member fastening means comprises a plurality of teeth on an outer surface of said cradle member and a plurality of teeth on an inner surface of said distal arcuate member, with the inner and outer teeth being engageable to lock the first clamp member in a closed position.

6. The bracket as set forth in claim 1 wherein said distributor assembly includes an equalizer line and further wherein said second clamp member is attached to said distribution assembly by way of said equalizer line.

7. The bracket as set forth in claim 1 wherein said second clamp member fastening means comprises two interlocking members that are locked in place by a hook and an edge.

8. A bracket for securing both a thermal expansion valve bulb and a distributor assembly to an outlet header of an air conditioning A-coil, comprising:

an elongate member having a first clamp member attached to one end, a second clamp member attached to its other end, and a cradle member at its one end, said cradle member being arcuate in form and adapted to engagingly receive said outlet header therein;

said first clamp member having a base arcuate member and a distal arcuate member, said base arcuate member being attached at its one end and to said elongate member and adapted to wrap around the thermal expansion valve bulb, and said distal arcuate member being attached to said base arcuate member other end and adapted to wrap around a portion of said outlet suction header;

a plurality of teeth on an outer surface of said cradle member and a plurality of teeth on an inner surface of said distal arcuate member, the inner and outer teeth being engageable to lock the first clamp member in a closed position to secure said first clamp member distal arcuate member to said outlet header; and said second clamp member having an arcuate member adapted to wrap around a portion of the distribution assembly and having two interlocking members that are locked in place by a hook and an edge.

9. The bracket as set forth in claim 8 wherein said bracket is a unitary member.

10. The bracket as set forth in claim 8 wherein said bracket is comprised of a plastic material.

11. The bracket as set forth in claim 8 and including an insulating member disposed between said thermal expansion valve bulb and said base arcuate member.

12. The bracket as set forth in claim 8 wherein said distributor assembly includes an equalizer line and further wherein said second clamp member is attached to said distribution assembly by way of said equalizer line.

13. The bracket as set forth in claim 8 wherein said base arcuate member is integrally attached to said elongate member.

14. The bracket as set forth in claim 8 wherein said distal arcuate member is integrally attached to said elongate member.

* * * * *